US011339535B2

(12) United States Patent
Nordling et al.

(10) Patent No.: US 11,339,535 B2
(45) Date of Patent: May 24, 2022

(54) METHOD OF PRODUCING A HIGHLY STRETCHABLE PAPER

(71) Applicant: BillerudKorsnäs AB, Solna (SE)

(72) Inventors: Nils Nordling, Kalix (SE); Tommy Stenman, Risögrund (SE); Erik Lindberg, Kalix (SE)

(73) Assignee: BillerudKorsnäs AB, Solna (SE)

( * ) Notice: Subject to any disclaimer, the term of this patent is extended or adjusted under 35 U.S.C. 154(b) by 120 days.

(21) Appl. No.: 16/500,319

(22) PCT Filed: Apr. 5, 2018

(86) PCT No.: PCT/EP2018/058716

§ 371 (c)(1),
(2) Date: Oct. 2, 2019

(87) PCT Pub. No.: WO2018/185215

PCT Pub. Date: Oct. 11, 2018

(65) Prior Publication Data

US 2020/0181843 A1 Jun. 11, 2020

(30) Foreign Application Priority Data

Apr. 6, 2017 (EP) ..... 17165151

(51) Int. Cl.
*D21F 11/02* (2006.01)
*D21G 1/00* (2006.01)
*D21H 27/10* (2006.01)

(52) U.S. Cl.
CPC ..... *D21F 11/02* (2013.01); *D21G 1/00* (2013.01); *D21H 27/10* (2013.01)

(58) Field of Classification Search
CPC ..... D21F 11/02; D21F 11/06; D21G 1/00; D21H 27/10; D21H 27/14; D21H 5/24; D21H 5/245
See application file for complete search history.

(56) References Cited

U.S. PATENT DOCUMENTS

2016/0355985 A1* 12/2016 Hashiguchi ..... D21H 27/005

FOREIGN PATENT DOCUMENTS

CN 1316030 A 10/2001
DE 102010029580 A1 12/2011
(Continued)

OTHER PUBLICATIONS

"International Preliminary Report on Patentability corresponding to International Application No. PCT/EP2018/058716 dated Oct. 17, 2019".

(Continued)

*Primary Examiner* — Jacob T Minskey
*Assistant Examiner* — Matthew M Eslami
(74) *Attorney, Agent, or Firm* — Myers Bigel, P.A.

(57) ABSTRACT

There is provided a method of producing a paper having a grammage according to ISO 536 of 50-250 g/m$^2$, a Gurley value according to ISO 5636-5 of above 15 s and a stretchability according to ISO 1924-3 in the machine direction of at least 9%, said method comprising the steps of: a) providing a pulp, preferably sulphate pulp; b) subjecting the pulp to refining; c) diluting the pulp from step b) and adding the diluted pulp to a forming wire to obtain a paper web; d) pressing and the paper web from step c); e) drying the paper web from step d); f) compacting the paper web from step e) in a Clupak unit at a moisture content of 32-50%, preferably 37-49%, more preferably 41-49%; g) calendering the paper web from step f), optionally after drying, at a moisture content of 21-40%, preferably 30-40%, more preferably 32-39%; h) drying the paper web from step g).

27 Claims, 1 Drawing Sheet

(56) References Cited

FOREIGN PATENT DOCUMENTS

| | | | | | |
|---|---|---|---|---|---|
| EP | 2186939 | A2 | | 5/2010 | |
| WO | 0014333 | A1 | | 3/2000 | |
| WO | WO-2011151239 | A2 | * | 12/2011 | ..... D21F 3/0218 |
| WO | 2016083170 | A1 | | 6/2016 | |

OTHER PUBLICATIONS

"International Search Report and Written Opinion corresponding to International Application No. PCT/EP2018/058716 dated May 2, 2018".

* cited by examiner

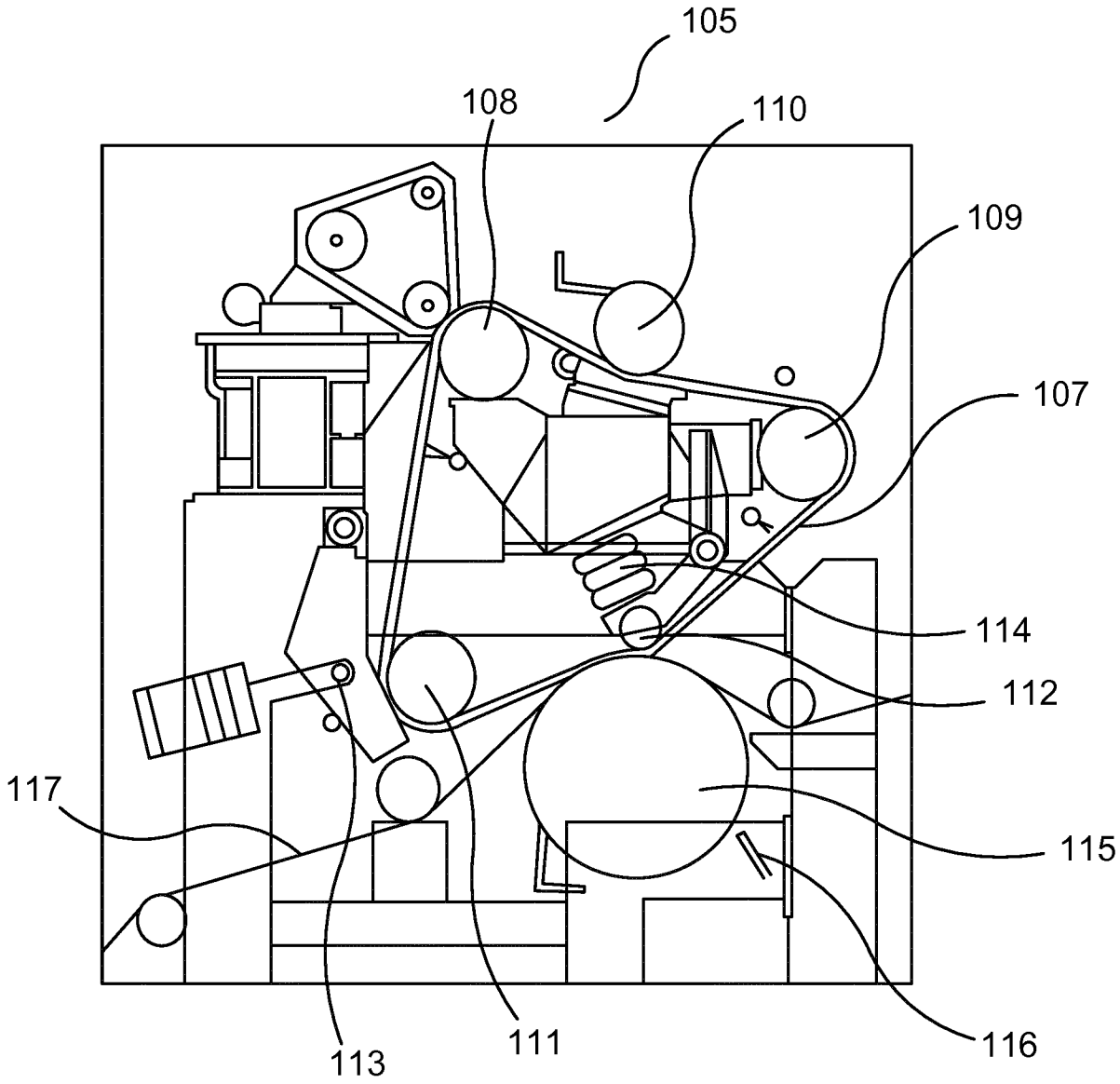
105
110
108
109
107
114
112
115
116
111
113
117

METHOD OF PRODUCING A HIGHLY STRETCHABLE PAPER

STATEMENT OF PRIORITY

This application is a 35 U.S.C. § 371 national phase application of PCT Application No. PCT/EP2018/058716 filed Apr. 5, 2018, which claims priority to European Application No. 17165151.6 filed Apr. 6, 2017, the entire contents of each of which is incorporated by reference herein.

TECHNICAL FIELD

The invention relates to a method of producing a highly stretchable paper, in particular such a paper having high stiffness and satisfactory surface properties.

BACKGROUND

BillerudKorsnäs AB (Sweden) has marketed a highly stretchable paper under the name FibreForm® since 2009. The stretchability of FibreForm® allows it to replace plastics in many applications. FibreForm has been produced on paper machine comprising an Expanda unit that compacts/creps the paper in the machine direction to improve the stretchability.

SUMMARY

Many applications of stretchable paper require stiffness and rigidity, which is typically reflected by the bending resistance of the paper.

The object of the present disclosure is to provide a method of producing a highly stretchable paper that is not a typical porous sack paper on a paper machine comprising a Clupak unit without compromising with printability or bending resistance.

There is thus provided a method of producing a paper having a grammage according to ISO 536 of 50-250 g/m$^2$, a Gurley value according to ISO 5636-5 of above 15 s and a stretchability according to ISO 1924-3 in the machine direction of at least 9%, said method comprising the steps of:

a) providing a pulp, preferably sulphate pulp;

b) subjecting the pulp to refining;

c) diluting the pulp from step b) and adding the diluted pulp to a forming wire to obtain a paper web;

d) pressing and the paper web from step c);

e) drying the paper web from step d);

f) compacting the paper web from step e) in a Clupak unit at a moisture content of 32-50%, preferably 37-49%, more preferably 41-49%;

g) calendering the paper web from step f), optionally after drying, at a moisture content of 21-40%, preferably 30-40%, more preferably 32-39%;

h) drying the paper web from step g).

BRIEF DESCRIPTION OF THE DRAWINGS

FIG. 1 is a schematic illustration of a Clupak unit.

DETAILED DESCRIPTION

The present disclosure relates to a method of producing a paper, which is preferably uncoated. Subsequent to the method of the present disclosure, the paper may be coated, e.g. to improve printing properties and/or to obtain barrier properties.

The paper obtained by the method is characterized by its stretchability, which is at least 9% in the machine direction (MD). Preferably, the stretchability in MD is even higher than 9%, such as at least 10% or at least 11%. The stretchability enables formation of three-dimensional (double curvature) shapes in the paper, e.g. by press forming, vacuum forming or deep drawing. The formability of the paper in such processes is further improved if the stretchability is relatively high also in the cross direction (CD). Preferably, the stretchability in CD is at least 7%, such as at least 9%. The stretchability (in both MD and CD) is determined according to the standard ISO 1924-3. An upper limit for the stretchability in MD may for example be 20% or 25%. An upper limit for the stretchability in CD may for example be 15%.

In contrast to many sack papers, which may be highly stretchable, the paper of the present disclosure is not particularly porous. Instead, relatively low porosity may be preferred in the applications intended for the paper of the present disclosure. For example, glue and some coatings have a lower tendency to bleed through a paper of low porosity. Further, some printing properties are improved when the porosity is reduced.

The air resistance according to Gurley, i.e. the Gurley porosity, is a measurement of the time (s) taken for 100 ml of air to pass through a specified area of a paper sheet. Short time means highly porous paper. The Gurley porosity of the paper of the present disclosure is above 15 s. The Gurley porosity is preferably at least 20 s and more preferably 30 s, such as at least 40 s. An upper limit for may for example be 120 s or 150 s. The Gurley porosity (herein also referred to as the "Gurley value") is determined according to ISO 5636-5.

The grammage of the paper of the present disclosure is 50-250 g/m$^2$. If a stretchable material having a grammage above 250 g/m$^2$ is desired, a laminate can be produced from a plurality of paper layers each having a grammage in the range of 50-250 g/m$^2$. Below 50 g/m$^2$ the strength and rigidity is typically insufficient. The grammage is preferably 60-220 g/m$^2$ and more preferably 80-200 g/m$^2$, such as 80-160 g/m$^2$, such as 80-130 g/m$^2$. The standard ISO 536 is used to determine the grammage. The Bendtsen roughness is typically lower when the grammage is lower.

For aesthetic and printing purposed, the paper of the present disclosure is preferably white. For example, its brightness according to ISO 2470 may be at least 80%, such as at least 82%. However, the paper may also be unbleached ("brown").

The method of the present disclosure comprises the step of:

a) providing a pulp.

The pulp is preferably a sulphate pulp (sometimes referred to as a "Kraft pulp"), which provides high tensile strength. For the same reason, the starting material used for preparing the pulp preferably comprises softwood (which has long fibers and forms a strong paper). Accordingly, the pulp may comprise at least 50% softwood pulp, preferably at least 75% softwood pulp and more preferably at least 90% softwood pulp. The percentages are based of the dry weight of the pulp.

The tensile strength is the maximum force that a paper will withstand before breaking. In the standard test ISO 1924-3, a stripe having a width of 15 mm and a length of 100 mm is used with a constant rate of elongation. Tensile energy absorption (TEA) is sometimes considered to be the paper property that best represents the relevant strength of a paper. The tensile strength is one parameter in the measurement of the TEA and another parameter is stretchability. The tensile strength, the stretchability and the TEA value are obtained in the same test. The TEA index is the TEA value divided by the grammage. In the same manner, the tensile index is obtained by dividing the tensile strength by the grammage.

A dry strength agent, such as starch, may be added to improve tensile strength. The amount of starch may for example be 1-15 kg per ton paper, preferably 1-10 or 2-8 kg per ton paper. The starch is preferably cationic starch.

In the context of the present disclosure, "per ton paper" refers to per ton of dried paper from the paper making process. Such dried paper normally has a dry matter content (w/w) of 90-95%.

The TEA index of the paper obtained by the method of the present disclosure may for example be at least 3.5 J/g (e.g. 3.5-7.0 J/g) in the MD and/or at least 2.8 J/g (e.g. 2.8-3.8 J/g) in the CD. In one embodiment, the TEA index is above 4.5 J/g in MD (e.g. 4.6-7.0 J/g).

One or more sizing agents may also be added to the pulp. Examples of sizing agents are AKD, ASA and rosin size. When rosin size is added, it is preferred to also add alum. Rosin size and alum is preferably added in a weight ratio between 1:1 and 1:2. Rosin size can for example be added in an amount of 0.5-4 kg per ton paper, preferably 0.7-2.5 kg per ton paper.

When the paper is white, the pulp is bleached.

The method further comprises the step of:

b) subjecting the pulp to refining.

The CD stretchability is increased by HC refining. By comparing the stretchability values obtained after HC refining at 150 and 220 kWh/ton paper, respectively, it has further been shown that a higher degree of HC refining results in higher CD stretchability. It is also been shown that the CD stretchability is increased by LC refining. By comparing the stretchability values obtained after 100, 150 and 200 kWh/ton paper of LC refining, respectively, it has further been shown that a higher degree of LC refining results in higher CD stretchability.

The effect of refining on stretchability is particularly pronounced when the refining is combined with "free drying", which is further discussed below.

Accordingly step b) comprises subjecting the pulp to high consistency (HC) refining in one embodiment of the method. In an alternative of complementary embodiment, step b) comprises subjecting the pulp to low consistency (LC) refining.

In a preferred embodiment, step b) comprises the substeps of:

b1) subjecting the pulp to high consistency (HC) refining; and b2) subjecting the pulp from step b1) to low consistency (LC) refining.

The consistency of the pulp subjected to HC refining is preferably at least 33% and more preferably above 36%. In particularly preferred embodiments, the consistency of the pulp subjected to HC refining is at least 37%, such as at least 38%. A typical upper limit for the consistency may be 42%.

The HC refining is typically carried out to the extent that the pulp obtains a Schopper-Riegler (SR) number of 13-19, such as 13-18. The SR number is measured according to ISO 5267-1. To reach the desired SR number, the energy supply in the HC refining may be at least 100 kWh per ton paper, such as above 150 kWh per ton paper. A typical upper limit may be 220 kWh per ton paper.

The consistency of the pulp subjected to LC refining is typically 2-6%, preferably 3-5%. The LC refining is typically carried out to the extent that the pulp obtains a Schopper-Riegler (SR) number of 18-40, preferably 19-35, such as 23-35. To reach the desired SR number, the energy supply in the LC refining may be 20-200 kWh per ton paper, such as 30-200 kWh per ton paper, such as 40-200 kWh per ton paper. As well known to the skilled person, LC refining increases the SR number.

In one embodiment, the method further comprises the step of adding broke pulp to the pulp in step b) or between step b) and step c) (step c) is discussed below). The broke pulp is preferably obtained from the same method.

The method further comprises the step of:

c) diluting the pulp from step b) and adding the diluted pulp to a forming wire to obtain a paper web.

The diluted pulp is thus dewatered on the forming wire and a paper web is formed. The diluted pulp typically has a pH of 5-6 and a consistency of 0.2-0.5%.

The paper web formed in step c) may for example have a dry content of 15-25%, such as 17-23%.

The method further comprises the step of:

d) pressing the paper web from step c), e.g. to a dry content of 30-50%, such as 36-46%.

The pressing section used for step d) typically has one, two or three press nips. In one embodiment, a shoe press is used. In such case, the nip of the shoe press can be the only nip of the pressing section. A benefit of using a shoe press is improved stiffness in the final product.

The method further comprises the step of:

e) drying the paper web from step d); and f) compacting the paper web from step e) in a Clupak unit at a moisture content of 32-50%, preferably 37-49%, more preferably 41-49%.

The compacting in the Clupak unit increases the stretchability of the paper, in particular in the MD, but also in the CD. To improve surface/printing properties, the moisture content of the paper is at least 32%, preferably at least 37%, more preferably at least 41%, when entering the Clupak unit. Higher moisture contents have also been shown to correlate with higher stretchabilities in the MD.

Further, the inventors have found that when the moisture content is high, surface properties are improved by an increase in the nip bar line load in the Clupak unit. An increased nip bar line load has also been found to improve the stretchability in MD and CD. Accordingly, the nip bar line load may be at least 22 kN/m in the Clupak unit. Preferably, the nip bar line load is at least 28 kN/m or at least 31 kN/m. A typical upper limit may be 38 kN/m. In the Clupak unit, the nip bar line load is controlled by the adjustable hydraulic cylinder pressure exerted on the nip bar. The nip bar is sometimes referred to as the "nip roll".

In one embodiment, the rubber belt tension in the Clupak unit is at least 5 kN/m (such as 5-9 kN/m), preferably at least 6 kN/m (such as 6-9 kN/m), such as about 7 kN/m. In the Clupak unit, the rubber belt tension is controlled by the adjustable hydraulic cylinder pressure exerted on the tension roll stretching the rubber belt.

The Clupak unit typically comprises a steel cylinder or a chromed cylinder. When the paper web is compacted by the contraction/recoil of the rubber belt in the Clupak unit, it moves relative the steel/chromed cylinder. To reduce the friction between the paper web and the steel/chromed cylinder, it is preferred to add a release liquid. The release liquid may be water or water-based. The water-based release liquid may comprise a friction-reducing agent, such as polyethylene glycol or a silicone-based agent. In one embodiment, the release liquid is water comprising at least 0.5%, preferably at least 1%, such as 1-4%, polyethylene glycol.

A Clupak unit is also described below with reference to FIG. 1.

The method further comprises the step of:

g) calendering the paper web from step f), optionally after drying, at a moisture content of 21-40%, preferably 30-40%, more preferably 32-39%. The calender used in step g) is preferably a soft nip calender. A soft nip calender comprises a hard roll, typically a steel roll. The steel roll may be heated, e.g. to a temperature of 75-150° C., preferably 90-130° C.

It has surprisingly been found that the "wet" calendering of step g) substantially improves surface properties without significantly reducing the stiffness/bending resistance of the paper (it may even increase stiffness/bending resistance). This is further discussed below under Examples. This surprising effect is particularly pronounced at lower line loads, such as 15-50 kN/m, preferably 15-42 kN/m, more preferably 15-40 kN/m, most preferably 17-35 kN/m.

The speed of the paper web in the calendering of step g) is preferably 8-14% lower than the speed of the paper web entering the Clupak unit in step f). A reason for lowering the speed in this manner is to maintain the MD stretchability obtained by the paper web in the Clupak unit.

After "wet" calendering, the paper web is subjected to further drying. Consequently, the method further comprises the step of h) drying the paper web from step g).

The paper web is preferably allowed to dry freely during part of step h) and/or between step f) and step g). During such "free drying", which improves the stretchability, the paper web is not in contact with a dryer screen (often referred to as a dryer fabric). A forced, optionally heated, air flow may be used in the free drying, which means that the free drying may comprise fan drying.

As mentioned above, the "wet" calendering of step g) improves surface properties without significantly reducing the bending stiffness of the paper. It may in fact even improve the bending stiffness.

Accordingly, the bending resistance index of the paper may be at least 38 $Nm^6/kg^3$ in the machine direction (MD) and/or the cross direction (CD).

In the MD, the bending resistance index of the paper is preferably at least 43 $Nm^6/kg^3$, such as at least 48 $Nm^6/kg^3$. A typical upper limit may be 60 or 62 $Nm^6/kg^3$.

In the CD, the bending resistance index of the paper is preferably at least 42 $Nm^6/kg^3$, such as at least 47 $Nm^6/kg^3$, such as at least 52 $Nm^6/kg^3$. A typical upper limit may be 60 or 65 $Nm^6/kg^3$.

The bending resistance index is obtained by dividing the bending resistance by the cube of the grammage. The bending resistance is measured according to ISO 2493 using a bending angle of 15° and a test span length of 10 mm.

One surface property that is improved by the "wet" calendering is the Bendtsen roughness. In one embodiment, the Bendtsen roughness according to ISO 8791-2 of at least one side of the paper is 1200 ml/min or lower, such as 1000 ml/min or lower, such as 900 ml/min or lower, such as 810 ml/min or lower (see e.g. tables 1 and 2, below).

The Bendtsen roughness values are generally lower for lower grammages. When the grammage according to ISO 536 of the paper is 80-130 $g/m^2$, the Bendtsen roughness according to ISO 8791-2 of at least one side of the paper may thus be 800 ml/min or lower, such as 600 ml/min or lower such as 500 ml/min or lower (see e.g. table 3, below). In such embodiments, the lower limit may for example be 300 ml/min or 350 ml/min. If the grammage is above 130 $g/m^2$, a lower limit may for example be 500 ml/min or 600 ml/min.

As understood by the skilled person, the above Bendtsen roughness values relate to uncoated paper.

As shown under Examples below, the side of the paper that contacted the steel roll in the soft nip calender has a finer surface than the other side of the paper. Accordingly, it is normally preferred to print the side of the paper that contacted the steel roll.

Therefore, when a soft nip calender is used for step g), the method may further comprise the step of:

i) printing the side of the paper that contacted the steel roll in step g). The steel roll is sometimes referred to as a steel cylinder.

FIG. 1 illustrates a Clupak unit 105, comprising an endless rubber belt 107 (sometimes referred to as a "rubber blanket") contacted by two blanket rolls 108, 109, a guide roll 110, a tension roll 111 and a nip bar 112. A first hydraulic arrangement 113 exerts pressure on the tension roll 111 to stretch the rubber belt 107. A second hydraulic arrangement 114 exerts pressure on the nip bar 112 to press the rubber belt 107, which in turns presses the paper web 117 against a steel cylinder 115. A release liquid spray nozzle 116 is arranged to apply a release liquid to the steel cylinder 115.

EXAMPLES

Full-scale trials were carried out to produce white stretchable paper on a paper machine that is also used for producing sack paper. Both wet-calendered (inventive) paper and non-calendered (reference) paper was produced.

The production is described below.

A bleached softwood sulphate pulp was provided. The pulp was subjected to high consistency (HC) refining (180 kWh per ton paper) at a consistency of about 39% and low consistency (LC) refining (65 kWh per ton paper) at a consistency of about 4.3%. Cationic starch (7 kg per ton paper), rosin size (2.4 kg per ton paper) and alum (3.5 kg per ton paper) were added to the pulp. In the headbox, the pH of the pulp/furnish was about 5.8 and the consistency of the pulp/furnish was about 0.3%. A paper web was formed on a wire section. The dry content of the paper web leaving the wire section was about 19%. The paper web was dewatered in a press section having two nips to obtain a dry content of about 38%. The dewatered paper web was then dried in a subsequent drying section having nine dryer groups, including one Clupak unit, arranged in series. In this context, the Clupak unit was thus considered to be a "dryer group". The Clupak unit was arranged as dryer group seven, which means that the paper web was dried in the drying section both before and after being compacted in the Clupak unit.

When entering the Clupak unit, the moisture content of the paper web was 40%. The hydraulic cylinder pressure exerted on the nip bar was set to 30 bar, resulting in a line load of 33 kN/m. The hydraulic cylinder pressure stretching the rubber belt was set to 31 bar, resulting in a belt tension of 7 kN/m. To reduce the friction between the paper web and the steel cylinder in the Clupak unit, a release liquid (1.5% polyetylene glycol) was added in an amount of 250 litre/hour. The speed of the paper web in dryer group eight, which was the dryer group arranged directly downstream the Clupak unit, was 11% lower than the speed of the paper web entering the Clupak unit.

A downstream portion of dryer group eight was rebuilt to comprise a soft calender nip (i.e. a nip between a roll having a hard (steel) surface and a roll having a soft (rubber) surface). The paper web was thus slightly dried between the Clupak unit and the soft calender nip, such that the web of the inventive paper was subjected to calendering at a moisture content of 35%. The line load was 40 kN/m. The temperature of the steel roll of the soft calender nip was about 100° C. The reference paper was not subjected to calendering.

The properties of the papers produced in the trials are presented in table 1 below.

TABLE 1

Properties of the calendered (inventive) paper and the non-calendered (reference) paper measured on samples from the top of the jumbo roll. The optitopo value corresponds to the percentage of a measured area that has valleys deeper than 4 micrometers (a lower value is better). The properties "Printing density" and uncovered area ("UCA") were however measured after the papers had been winded into a customer reel and printed. Regarding "Printing density", a higher number is better. Regarding UCA, a lower number is better.

| Trial | Wet-calendered (inventive) paper | Non-calendered (reference) paper |
|---|---|---|
| Grammage (g/m$^2$) | 150 | 150 |
| Thickness (μm) | 178 | 195 |
| Density (kg/m$^3$) | 848 | 764 |
| Tensile strength, MD/CD (kN/m) | 13.9/6.4 | 12.4/6.9 |
| Tensile index, MD/CD (kNm/kg) | 92/42 | 83/46 |
| Stretchability, MD (%) | 14.7 | 14.4 |
| Stretchability, CD (%) | 9.1 | 9.9 |
| TEA, MD/CD (J/m$^2$) | 911/422 | 1010/479 |
| TEA index, MD/CD (J/g) | 6.0/2.8 | 6.8/3.2 |
| Burst strength (kPa) | 767 | 775 |
| Burst index (mN/kg) | 5.1 | 5.2 |
| Bending resistance, MD (mN) | 147 | 170 |
| Bending resistance, CD (mN) | 199 | 194 |
| Bending resistance index, MD (Nm$^6$/kg$^3$) | 43.6 | 50.4 |
| Bending resistance index, CD (Nm$^6$/kg$^3$) | 59.0 | 57.5 |
| Gurley value (s) | 55 | 38 |
| Brightness (%) | 82.6 | ~83 |
| Bendtsen roughness, SS* (ml/min) | 963 | 1596 |
| Bendtsen roughness, RS** (ml/min) | 1288 | 3246 |

TABLE 1-continued

Properties of the calendered (inventive) paper and the non-calendered (reference) paper measured on samples from the top of the jumbo roll. The optitopo value corresponds to the percentage of a measured area that has valleys deeper than 4 micrometers (a lower value is better). The properties "Printing density" and uncovered area ("UCA") were however measured after the papers had been winded into a customer reel and printed. Regarding "Printing density", a higher number is better. Regarding UCA, a lower number is better.

| Trial | Wet-calendered (inventive) paper | Non-calendered (reference) paper |
|---|---|---|
| Printing density, SS* | 1.56 | 1.56 |
| Printing density, RS** | 1.58 | 1.48 |
| UCA (%), SS* | 0.01 | |
| UCA (%), RS** | 0.03 | 0.147 |
| Optitopo value (%), SS* | 0.57 | 1.5 |
| Optitopo value (%), RS** | 3.55 | 9.0 |

*Steel side in calender
**Rubber side in calender

As shown in table 1, a highly stretchable uncoated white paper having a high Gurley value (i.e. low porosity) was obtained. Table 1 further shows that the "wet" calendering significantly improved the surface properties Bendtsen roughness and optitopo and the print quality measured as UCA. The side of the paper that contacted the (hard) steel roll exhibited better surface and printing properties than the side that contacted the (soft) rubber-covered roll. The "steel side" is thus more suitable for printing. The "wet" calendering decreased the bending resistance only to a small degree in the MD and actually slightly increased the bending resistance in CD.

Another trial was carried out, in which the line load in the soft nip calender was varied. Otherwise, the paper was produced in accordance with the full-scale trials described above. The resulting paper properties are presented in table 2 below.

TABLE 2

Paper properties of calendered (inventive) paper and non-calendered (reference) paper. The sample taken "After jumbo roll and winding" was obtained from the top (i.e. an outer layer) of a customer roll.

| | Trial | | | | |
|---|---|---|---|---|---|
| | Inventive paper | Inventive paper | Inventive paper | Inventive paper | Reference paper |
| | Sample taken | | | | |
| | After jumbo roll and winding | Top of jumbo roll | Top of jumbo roll | Top of jumbo roll | Top of jumbo roll |
| Wet calendering line load (kN/m) | 30 | 30 | 40 | 50 | 0 |
| Grammage (g/m$^2$) | 150 | 150 | 150 | 150 | 150 |
| Thickness (μm) | 175 | 178 | 176 | 175 | 200 |
| Density (kg/m$^3$) | 861 | 859 | 867 | 870 | 765 |
| Stretchability, MD (%) | 14.8 | 14.7 | 14.3 | 15.0 | 14.6 |
| Stretchability, CD (%) | 9.6 | 10.0 | 9.7 | 9.8 | 9.9 |
| TEA index, MD/CD (J/g) | 6.8/3.0 | 6.7/3.2 | 6.3/3.2 | 6.6/3.2 | 6.6/3.2 |
| Burst index (mN/kg) | 5.0 | 5.0 | 5.3 | 5.2 | 4.8 |
| Bending resistance, MD (mN) | 180 | 190 | 175 | 169 | 165 |
| Bending resistance, CD (mN) | 194 | 191 | 193 | 155 | 169 |
| Bending resistance index, MD (Nm$^6$/kg$^3$) | 53.3 | 56.3 | 51.9 | 50.1 | 48.9 |
| Bending resistance index, CD (Nm$^6$/kg$^3$) | 57.5 | 56.6 | 57.2 | 45.9 | 50.1 |

TABLE 2-continued

Paper properties of calendered (inventive) paper and non-calendered (reference) paper. The sample taken "After jumbo roll and winding" was obtained from the top (i.e. an outer layer) of a customer roll.

| | Trial | | | | |
|---|---|---|---|---|---|
| | Inventive paper | Inventive paper | Inventive paper | Inventive paper | Reference paper |
| | Sample taken | | | | |
| | After jumbo roll and winding | Top of jumbo roll | Top of jumbo roll | Top of jumbo roll | Top of jumbo roll |
| Gurley value (s) | 82 | 86 | 92 | 103 | 57 |
| Bendtsen roughness, SS* (ml/min) | 738 | 747 | 806 | 749 | 1451 |
| Bendtsen roughness, RS** (ml/min) | 1492 | 1793 | 1728 | 1688 | 3541 |

*Steel side in calender,
**Rubber side in calender

As shown in table 2, highly stretchable uncoated white papers having high Gurley values (i.e. low porosities) were obtained again. Table 2 also confirms that wet-calendering significantly improves surface properties. In particular, the side of the paper contacting the (hard) steel roll in the wet calendering step obtained a fine surface (low Bendtsen roughness) independently of the line load. Surprisingly, it can thus be concluded that it was not necessary to use high line loads to obtain a significantly reduced Bendtsen roughness. More surprisingly, it was found that the wet calendering generally did not decrease the stiffness (measured as the bending resistance) of the paper. The lower line loads (≤40 kN/m) even increased the bending resistance in both MD and CD despite that the density was increased.

Table 2 also illustrates that the winding of the paper to a jumbo roll and the subsequent winding to a customer roll improve the surface properties. The properties of the paper samples taken from the top of the jumbo roll are not a fair representation of the paper that is shipped to the customer. However, the effects seen by comparing paper samples taken from the same position are still valid.

Another set of trials were carried out, in which the grammage was 100 g/m$^2$ and the moisture content and nip pressure in the Clupak unit were varied. Otherwise, the paper was produced in accordance with the full-scale trials described above. The resulting paper properties are presented in table 3 below.

TABLE 3

Paper properties of calendered and non-calendered 100 g/m$^2$ paper samples taken from the jumbo roll after storage. In the production of the "inventive" paper, the moisture content of the paper web entering the Clupak unit was 40 or 45% and the paper web was subsequently subjected to wet calendering (40 kN/m). In the production of the "reference" paper, the moisture content of the paper web entering the Clupak unit was 30% and/or the paper web was not subjected to wet calendering (0 kN/m). The optitopo value corresponds to the percentage of a measured area that has valleys deeper than 4 micrometers.

| Wet calendering Line load (kN/m) | Clupak unit Moisture content (%) | Clupak unit Nip bar line load (kN/m) | Optitopo value, RS (%) | Optitopo value, SS (%) | BR, RS (ml/min) | BR, SS (ml/min) |
|---|---|---|---|---|---|---|
| 0 (reference) | 45 | 33 | 5.83 | 0.78 | 1781 | 711 |
| 40 (inventive) | 45 | 33 | 2.43 | 0.23 | 638 | 410 |
| 40 (inventive) | 45 | 27.5 | 2.79 | 0.31 | 705 | 455 |
| 40 (inventive) | 40 | 33 | 3.53 | 0.48 | 828 | 478 |
| 40 (inventive) | 40 | 27.5 | 3.69 | 0.54 | 827 | 497 |
| 0 (reference) | 40 | 27.5 | 7.79 | 1.49 | 2091 | 796 |
| 0 (reference) | 40 | 33 | 7.12 | 1.22 | 2058 | 771 |
| 0 (reference) | 30 | 33 | 8.81 | 1.95 | 2403 | 921 |
| 0 (reference) | 30 | 27.5 | 9.56 | 2.6 | 2574 | 1000 |
| 40 (reference) | 30 | 27.5 | 5.42 | 1.16 | 1057 | 591 |
| 40 (reference) | 30 | 33 | 4.58 | 0.81 | 1015 | 602 |

"BR" refers to Bendtsen roughness. "SS" means steel side in the calender and "RS" means rubber side in calender.

Table 3 shows that all the inventive papers have lower Optitopo values ("fewer deep valleys") and finer surfaces (lower Bendtsen roughness values) than all the reference papers for both sides of the paper. It is further shown that an increase in the moisture content of the paper web entering the Clupak unit significantly improves the surface properties. It is also shown that increasing the nip bar line load in the Clupak unit improves the surface properties. The best values are obtained when the moisture content of the paper entering the Clupak unit is above 40% and the nip bar line load in the Clupak unit is above 27.5 kN/m.

The invention claimed is:

1. Method of producing a paper having a grammage according to ISO 536 of 50-250 g/m$^2$, a Gurley value according to ISO 5636-5 of above 15 s and a stretchability according to ISO 1924-3 in the machine direction of at least 9%, said method comprising the steps of:

a) providing a pulp;

b) subjecting the pulp to refining;

c) diluting the pulp from step b) and adding the diluted pulp to a forming wire to obtain a paper web;

d) pressing and the paper web from step c);

e) drying the paper web from step d);

f) compacting the paper web from step e) in a Clupak unit at a moisture content of 32-50%;

g) calendering the paper web from step f) at a moisture content of 21-40%;

h) drying the paper web from step g).

2. The method of claim 1, wherein the calendering of step g) is performed at a line load of 15-50 kN/m.

3. The method of claim 1, wherein a soft nip calender is used in step g).

4. The method of claim 1, wherein the Clupak unit has a nip bar with a line load of at least 22 kN/m.

5. The method of claim 1, wherein the paper has a bending resistance index according to ISO 2493 in the machine direction (MD) of at least 38 Nm$^6$/kg$^3$, and wherein the bending resistance is tested using a bending angle of 15° and a test span length of 10 mm.

6. The method of claim 1, wherein the paper has a bending resistance index according to ISO 2493 in the cross direction (CD) of at least 42 Nm$^6$/kg$^3$, and wherein the bending resistance is tested using a bending angle of 15° and a test span length of 10 mm.

7. The method of claim 1, wherein the paper has a Bendtsen roughness according to ISO 8791-2 of 1200 ml/min or lower.

8. The method of claim 1, wherein the paper has a grammage according to ISO 536 of 80-130 g/m$^2$ and at least one side of the paper has a Bendtsen roughness according to ISO 8791-2 of 800 ml/min or lower.

9. The method of claim 1, wherein the stretchability according to ISO 1924-3 in the machine direction is at least 10%.

10. The method of claim 1, wherein the stretchability according to ISO 1924-3 in the cross direction is at least 9%.

11. The method of claim 1, wherein the grammage according to ISO 536 of the paper is 60-220 g/m$^2$.

12. The method of claim 1, wherein the Gurley value according to ISO 5636-5 of the paper is at least 20 s.

13. The method of claim 1, wherein the paper has a brightness according to ISO 2470 of at least 80%.

14. The method of claim 1, wherein the paper web in step g) has a speed 8-14% lower than the speed of the paper web entering the Clupak unit in step f).

15. The method of claim 1, wherein the paper has a TEA index according to ISO 1924-3 of at least 3.5 J/g in the machine direction and/or at least 2.8 J/g in the cross direction of the paper.

16. The method of claim 1, wherein the paper web from step e) is compacted in the Clupak unit of step f) at a moisture content of 37-49%.

17. The method of claim 16, wherein the paper web from step e) is compacted in the Clupak unit of step f) at a moisture content of 41-49%.

18. The method of claim 1, wherein the paper web is calendered at a moisture content of 30-40% in step g).

19. The method of claim 18, wherein the paper web is calendered at a moisture content of 32-39% in step g).

20. The method of claim 2, wherein the line load in the calendering of step g) is 15-40 kN/m.

21. The method of claim 4, wherein the line load of the nip bar in the Clupak unit is at least 28 kN/m.

22. The method of claim 5, wherein the bending resistance index according to ISO 2493 in the machine direction (MD) of the paper is at least 43 Nm$^6$/kg$^3$ and wherein the bending resistance is tested using a bending angle of 15° and a test span length of 10 mm.

23. The method of claim 6, wherein the bending resistance index according to ISO 2493 in the cross direction (CD) of the paper is at least 47 Nm$^6$/kg$^3$ and wherein the bending resistance is tested using a bending angle of 15° and a test span length of 10 mm.

24. The method of claim 7, wherein the Bendtsen roughness according to ISO 8791-2 of at least one side of the paper is 900 ml/min or lower.

25. The method of claim 8, wherein the grammage according to ISO 536 of the paper is 80-130 g/m$^2$ and the Bendtsen roughness according to ISO 8791-2 of at least one side of the paper is 600 ml/min or lower.

26. The method of claim 1, wherein the pulp is sulphate pulp.

27. The method of claim 1, further comprising drying the paper web after step f).

* * * * *